US006459192B1

(12) United States Patent
Lammers

(10) Patent No.: US 6,459,192 B1
(45) Date of Patent: Oct. 1, 2002

(54) ELECTRIC LAMP

(75) Inventor: Liane Lammers, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 140 days.

(21) Appl. No.: 09/616,633

(22) Filed: Jul. 26, 2000

(30) Foreign Application Priority Data

Jul. 27, 1999 (EP) ..... 99202461

(51) Int. Cl.[7] ..... H01J 61/30; H01J 61/36; H01J 61/34

(52) U.S. Cl. ..... 313/25; 313/253; 313/269; 313/634

(58) Field of Search ..... 313/623, 25, 566, 313/269, 274, 285, 286, 253, 42, 634

(56) References Cited

U.S. PATENT DOCUMENTS 3,882,346 A * 5/1973 McVaey ..... 313/253
3,753,018 A * 8/1973 Beijer et al. ..... 313/25
5,164,630 A 11/1992 Greiler et al. ..... 313/25

FOREIGN PATENT DOCUMENTS

EP 0476461 B1 3/1992 ..... H01J/61/30
EP 0476461 A1 3/1992 ..... H01J/61/30

* cited by examiner

*Primary Examiner*—Ashok Patel
(74) *Attorney, Agent, or Firm*—Dicran Halajian; Frank J. Keegan

(57) ABSTRACT

The electric lamp has a tubular envelope (1) in which a lamp vessel (10) is axially accommodated, held by a first (5) and a long second pole wire (6). The second pole wire (6) has a longitudinal portion (61) merging at a first bend (611) into a first Z-shaped support portion (62) having support points (621, 622) against the envelope (1). The first support portion (62) is connected to a transverse portion (63) to which a current conductor (12) of the lamp vessel (10) is secured and which is connected to a second support portion (64) which extends in an axial plane along the lamp vessel (10) and has a support point (641) against the envelope (1). The second pole wire (6) is effective in supporting the lamp vessel (10) and maintaining the position thereof.

12 Claims, 2 Drawing Sheets

ELECTRIC LAMP

BACKGROUND OF THE INVENTION

The invention relates to an electric lamp provided with:

a light-transmitting envelope with an axis and a first and a second tubular end portion, a first and a second pole wire entering the lamp at the first end portion;

a light-transmitting gas-filled lamp vessel which is closed in a vacuumtight manner and is axially arranged in the envelope, into which lamp vessel a first and a second current conductor enter at mutually opposed locations, which current conductors are connected to an electric element in the lamp vessel and are fastened to the first and the second pole wire, respectively, outside the lamp vessel, the second pole wire having a longitudinal portion which extends along the lamp vessel to the second end portion of the envelope and into which a Z-shaped first support portion merges at a first bend location, which first support portion has a first support location adjacent the longitudinal portion and a second support location, and a central portion between said support locations, and which first support portion is connected to a transverse portion which runs transversely through the envelope, to which the second current conductor is fastened, and by means of which a second support portion extending along the lamp vessel opposite the first support portion is connected to a support location, said support portions bearing on the second end portion of the envelope.

Such an electric lamp is known from EP-B-0 476 461.

The second support portion in the known lamp has a shape which is identical to that of the first support portion, or is the mirrored image thereof. The first bend location has the purpose of keeping the first and the second support location at a distance from one another in a direction transverse to the axis. Both support portions have a central portion between their support locations which extends perpendicularly to the axis of the envelope. As a result, the support locations are spaced away from one another also in axial direction at each of the two support portions. The two central portions run parallel to one another.

The pole wires have the purpose not only to provide the lamp vessel with electric current, but also to bring and maintain the lamp vessel in a predetermined location in the envelope, also if the lamp has been subjected to shocks or vibrations. The first pole wire has a comparatively small length, and accordingly a sufficient stiffness for its mechanical purpose. The second pole wire extends along the lamp vessel and is longer than the first, and as a result it has a lower stiffness for a same given lateral dimension. The second pole wire must be supported by the envelope in the second end portion if it is to keep the lamp vessel fixed in the envelope.

The internal dimensions of the envelope of a batch of lamps of the same type is subject to fluctuations owing to tolerances in its manufacture. The dimensions of the second pole wire of such a batch of lamps are similarly subject to fluctuations, while in addition the shape of the pole wire may vary, which gives rise to skew dimensions. It was found that these factors may have the result that the second pole wire bears on the envelope in no more than three support locations, which do not lie distributed around the lamp vessel owing to the geometry of the second pole wire, or even in no more than two support locations. The lamp vessel is then insufficiently accurately positioned and insufficiently supported. Such a lamp will rattle when it is shaken.

SUMMARY OF THE INVENTION

It is an object of the invention to provide an electric lamp of the kind described in the opening paragraph which is of a simple and effective construction, whereby the lamp vessel is adequately supported.

According to the invention, this object is achieved in that the second support portion extends substantially in a plane through the axis towards its support location against the envelope.

The second pole wire has three support locations distributed over the circumference of the lamp vessel on account of its shape. The pole wire thus provides a reliable and effective support to and positioning of the lamp vessel. Dimension and shape tolerances of the second pole wire and the envelope are readily compensated for, so that rattling is avoided. The pole wire may readily be manufactured in one piece, which avoids welded joints in the pole wire.

In a favorable embodiment, the central portion of the first support portion crosses the axis at an acute angle and extends from the first support location to the second support location back to the longitudinal portion. This has the advantage that the first support portion is less stiff and more elastic than if it were perpendicular to the axis of the envelope, as in the known lamp. The first and the second support location can move relative to one another in the case of a lateral impact against the lamp. Since also the third support location, i.e. the support location of the second support portion, is resilient owing to the shape of this support location, all support locations are mutually resilient in this embodiment. The lamp vessel is resiliently supported around the axis. As a result, the lamp has a high shock resistance. Another advantage of this embodiment is that the two support locations of the first support portion, unlike in the known lamp, may be present at the same level in a plane which is substantially perpendicular to the axis. This enhances the symmetry of the construction.

It is favorable when the longitudinal portion has a second bend location where the second pole wire is bent towards the axis. This embodiment on the one hand renders it possible to have the longitudinal portion extend substantially straight along the envelope, while nevertheless sufficient room is created for the first support portion and for support locations thereof mutually spaced apart transversely to the axis, because the second bend location brings the first support portion closer to the axis. A sloping trend of the longitudinal portion adjacent the envelope renders possible a comparatively great distance to the lamp vessel, for example a locally convex lamp vessel, given certain chosen lateral dimensions, or a comparatively narrow envelope.

In a favorable modification, the first and the second bend location coincide. This modification limits the number of bending operations in the manufacture of the pole wire.

It is favorable when the support location of the second support portion lies substantially in a plane through the axis and through a point centrally located between the support locations of the first support portion. This measure promotes the symmetry of the support of the lamp vessel.

In an embodiment, the transverse portion has a straight fastening portion to which the second current conductor is fastened and a bent portion which retains the second support portion substantially in a plane through the axis and through a point centrally located between the support locations of the first support portion. This embodiment has the advantage that it renders it easier to mount the lamp vessel coaxially with the envelope.

A particularly favorable embodiment is one in which the support locations of the first support portion and the support location of the second support portion lie substantially in a plane which is perpendicular to the axis. The support locations in this case make contact with the envelope at least substantially simultaneously during mounting in the envelope. The risk of inadvertent warping is counteracted thereby, and the support portions will adapt themselves at least substantially simultaneously to the envelope if the second pole wire should have an excess dimension with respect to the envelope owing to tolerances.

The electric lamp according to the invention may be an incandescent lamp, for example a halogen incandescent lamp. The electric element in that case is an incandescent body, and the lamp vessel is filled with a gas comprising halogen, for example with xenon and hydrogen bromide. Alternatively, however, the lamp may be a discharge lamp, in which case the electric element is a pair of electrodes and the gas in the lamp vessel is ionizable.

The lamp vessel of the incandescent or discharge lamp will usually be made of quartz glass, but it may alternatively be made of a ceramic material such as, for example, polycrystalline aluminum oxide. The discharge lamp has an ionizable filling such as, for example, mercury, sodium, metal halide, or combinations thereof, with a rare gas as a starter gas. The lamp vessel may be tubular, or alternatively may enclose a rounded, for example spherical or oval space.

The envelope may be tubular or may be rounded between its end portions. The envelope is usually made of quartz glass or hard glass. The envelope may be closed in a vacuumtight manner, for example with a pinch seal at the first end portion. The envelope may be filled with gas or may be evacuated. The envelope may support a lamp cap at the first end portion, for example made of ceramic material and having contacts to which the pole wires are electrically connected.

BRIEF DESCRIPTION OF THE INVENTION

An embodiment of the electric lamp according to the invention is shown in the drawing, in which FIG. 1 shows a discharge lamp in perspective view;

Figure 1:
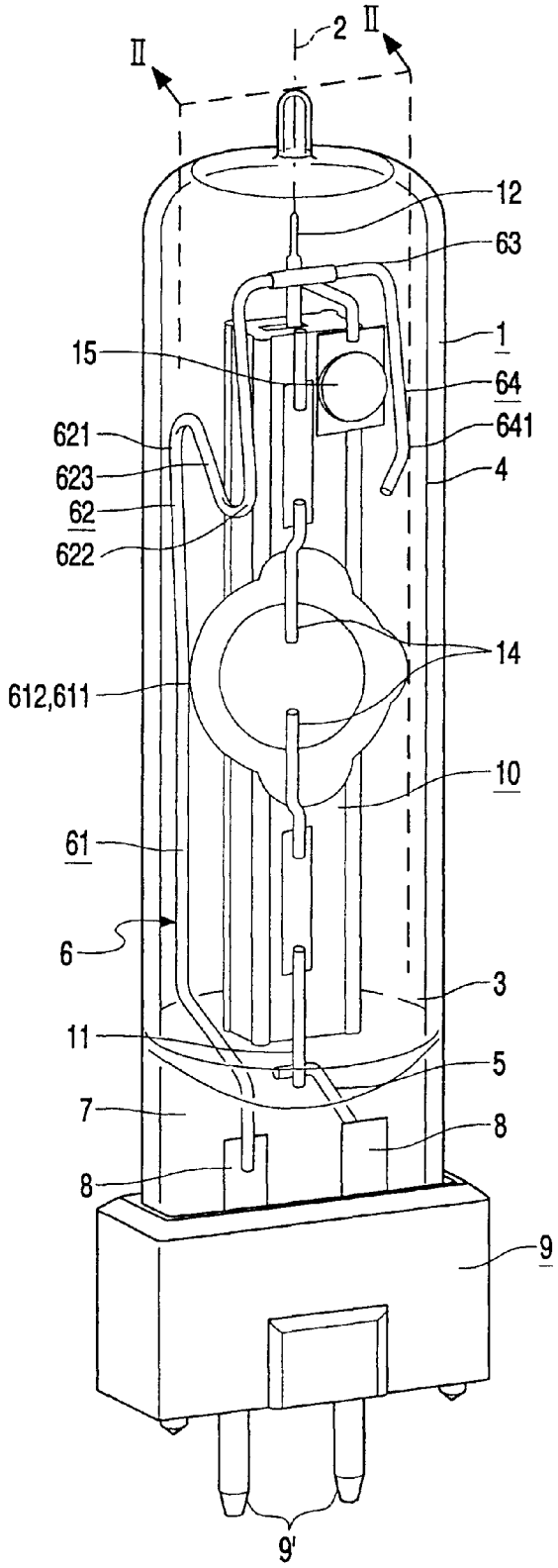

In FIG. 1, the electric lamp has a light-transmitting envelope 1, which is made of quartz glass in the Figure, with an axis 2 and a first 3 and a second tubular end portion 4. A first 5 and a second pole wire 6, made of molybdenum in the Figure, enter the lamp at the first end portion 3. The lamp shown has a pinch seal 7 in that location, in which ends of the pole wires 5, 6 are embedded and are connected to metal foils 8 which join the pole wires 5, 6 to contact pins 9' of a ceramic lamp cap 9 in which the pinch seal 7 is fixedly retained.

A light-transmitting gas-filled lamp vessel 10, made of quartz glass in the Figure, is closed in a vacuumtight manner and is axially positioned in the envelope 1. A first 11 and a second current conductor 12, made of molybdenum in the Figure, enter said lamp vessel at mutually opposed sides. Said conductors are connected to an electric element 14 in the lamp vessel 10, a pair of tungsten electrodes in the Figure, and are fastened to the first 5 and the second pole wire 6, respectively, outside the lamp vessel 10. The lamp vessel 10 has a spherically rounded discharge space in its central region. A getter 15 is mounted near the lamp vessel 10.

The second pole wire 6 has a longitudinal portion 61 which extends along the lamp vessel 10 to the second end portion 4 of the envelope 1 and into which a Z-shaped first support portion 62 merges in a first bend location 611. The first support portion 62 has a first support location 621 against the envelope 1 adjacent the longitudinal portion 61 and a second support location 622, as well as a central portion 623 between said support locations 621, 622. The second pole wire 6 is bent back in the bend location 611, so that the pole wire 6 subsequently will first extend behind the plane of drawing II of FIG. 2 (see also FIG. 3). The first support portion 62 is connected to a transverse portion 63 which runs across the envelope 1, to which the second current conductor 12 is fastened, and to which a second support portion 64 extending along the lamp vessel 10 and having a support location 641 is connected. The support portions 62, 64 bear with their support locations 621, 622, 641 on the second end portion 4 of the envelope 1.

Figure 3:
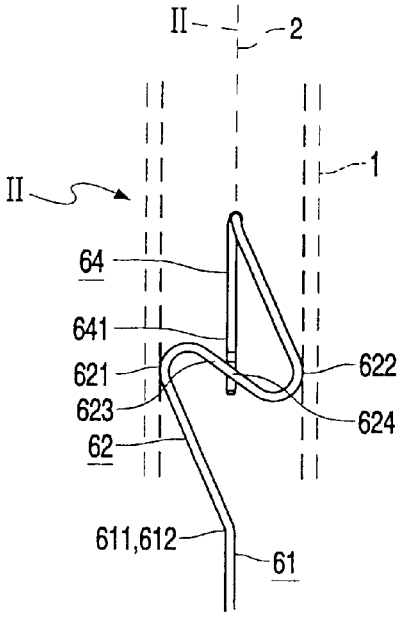
FIG. 3 shows a portion of the second pole wire taken on the line III in FIG. 2.

The second support portion 64 extends substantially in a plane through the axis 2 towards its support location 641 against the envelope 1 (cf. FIG. 3).

In the lamp shown, the central portion 623 of the first support portion 62 crosses the axis 2 at an acute angle, unlike in the known lamp, and extends from the first support location 621 to the second support location 622 back to the longitudinal portion 61. As is also visible in FIG. 3, the first support portion has a double hairpin bend. As a result, the first support portion 62 has elasticity also in the plane of drawing of FIG. 3.

Figure 2:
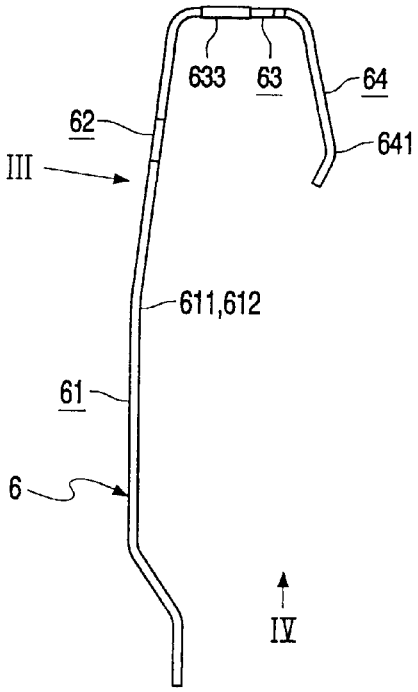
FIG. 2 shows the second pole wire of FIG. 1 viewed in plane II of FIG. 1.

In the embodiment shown, see FIG. 2, the longitudinal portion 61 has a second bend location 612 where the second pole wire 6 is bent towards the axis 2. The first 611 and the second bend location 612 coincide in this embodiment (cf. FIGS. 2 and 3). The bend locations 611, 612 in the lamp shown are situated at the level of the greatest transverse dimension of the lamp vessel 10. Beyond this location, the space between the envelope 1 and the lamp vessel 10 increases, and the second pole wire 6 may follow a path which has a direction component towards the axis 2.

Figure 4:
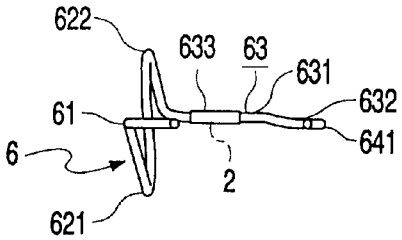
FIG. 4 shows the second pole wire taken on the line IV in FIG. 2.

The support location 641 of the second support portion 64 in the embodiment shown lies substantially in a plane, plane II in the drawing, i.e. the plane of drawing of FIG. 2, which passes through the axis 2 and through a point 624 (see FIG. 3) centrally located between the support locations 621, 622 of the first support portion 62, as is apparent from FIG. 4. It is also apparent therefrom that the transverse portion 63 has a straight fastening portion 631 to which the second current conductor 12 is fastened (see FIG. 1) and a bent portion 632 which keeps the second support portion 64 substantially in a plane through the axis 2 and through a point 624 centrally located between the support locations 621, 622 of the first support portion 62.

The transverse portion 63 locally has a nickel envelope 633 for realizing a good weld to the second current conductor 12 (see FIGS. 2 and 4).

As is evident from FIG. 3, the support locations 621, 622; 641 lie substantially in a plane perpendicular to the axis 2. The wall portions of the envelope 1 on which the first support portion 62 bears have been indicated with broken lines in this Figure.

The lamp shown is a metal halide lamp which consumes a power of 250 W during operation. Another version of the lamp has a power of 575 W.

The lamp shown embodies all the additional special features described above. Alternative versions of the lamp, however, may embody only one or a few of the additional special features described.

I claim:

1. An electric lamp provided with:

a light-transmitting envelope with an axis and a first and a second tubular end portion, a first and a second pole wire entering the lamp at the first end portion;

a light-transmitting gas-filled lamp vessel which is closed in a vacuumtight manner and is axially arranged in the envelope, into which lamp vessel a first and a second current conductor enter at mutually opposed locations, which current conductors are connected to an electric element in the lamp vessel and are fastened to the first and the second pole wire, respectively, outside the lamp vessel, the second pole wire having a longitudinal portion which extends along the lamp vessel to the second end portion of the envelope and into which a Z-shaped first support portion merges at a first bend location, which first support portion has a first support location adjacent the longitudinal portion and a second support location, and a central portion between said support locations, which first support portion is connected to a transverse portion which runs transversely through the envelope, to which the second current conductor is fastened, and by means of which a second support portion extending along the lamp vessel opposite the first support portion is connected to a support location, said support portions bearing on the second end portion of the envelope, wherein the second support portion extends substantially in a plane through the axis towards its support location against the envelope, and wherein the central portion of the first support portion crosses the axis at an acute angle and extends from the first support location to the second support location back to the longitudinal portion.

2. An electric lamp as claimed in claim wherein the longitudinal portion has a second bend location where the second pole wire is bent towards the axis.

3. An electric lamp as claimed in claim 2, wherein the support locations lie substantially in a plane which is perpendicular to the axis.

4. An electric lamp provided with:

a light-transmitting envelope with an axis and a first and a second tubular end portion, a first and a second pole wire entering the lamp at the first end portion;

a light-transmitting gas-filled lamp vessel which is closed in a vacuumtight manner and is axially arranged in the envelope, into which lamp vessel a first and a second current conductor enter at mutually opposed locations, which current conductors are connected to an electric element in the lamp vessel and are fastened to the first and the second pole wire, respectively, outside the lamp vessel, the second pole wire having a longitudinal portion which extends along the lamp vessel to the second end portion of the envelope and into which a Z-shaped first support portion merges at a first bend location, which first support portion has a first support location adjacent the longitudinal portion and a second support location, and a central portion between said support locations, which first support portion is connected to a transverse portion which runs transversely through the envelope, to which the second current conductor is fastened, and by means of which a second support portion extending along the lamp vessel opposite the first support portion is connected to a support location, said support portions bearing on the second end portion of the envelope, wherein the second support portion extends substantially in a plane through the axis towards its support location against the envelope, wherein the longitudinal portion has a second bend location where the second pole wire is bent towards the axis, and wherein the first and the second bend location coincide.

5. An electric lamp provided with:

a light-transmitting envelope with an axis and a first and a second tubular end portion, a first and a second pole wire entering the lamp at the first end portion;

a light-transmitting gas-filled lamp vessel which is closed in a vacuumtight manner and is axially arranged in the envelope, into which lamp vessel a first and a second current conductor enter at mutually opposed locations, which current conductors are connected to an electric element in the lamp vessel and are fastened to the first and the second pole wire, respectively, outside the lamp vessel, the second pole wire having a longitudinal portion which extends along the lamp vessel to the second end portion of the envelope and into which a Z-shaped first support portion merges at a first bend location, which first support portion has a first support location adjacent the longitudinal portion and a second support location, and a central portion between said support locations, which first support portion is connected to a transverse portion which runs transversely through the envelope, to which the second current conductor is fastened, and by means of which a second support portion extending along the lamp vessel opposite the first support portion is connected to a support location, said support portions bearing on the second end portion of the envelope, wherein the second support portion extends substantially in a plane through the axis towards its support location against the envelope, and wherein the support location of the second support portion lies substantially in a plane through the axis and through a point centrally located between the support locations of the first support portion.

6. An electric lamp as claimed in claim 5, wherein the transverse portion has a straight fastening portion to which the second current conductor is fastened and a bent portion which retains the second support portion substantially in a plane through the axis and through the point centrally located between the support locations of the first support portion.

7. An electric lamp provided with:

a light-transmitting envelope with an axis and a first and a second tubular end portion, a first and a second pole wire entering the lamp at the first end portion;

a light-transmitting gas-filled lamp vessel which is closed in a vacuumtight manner and is axially arranged in the envelope, into which said lamp vessel a first and a second current conductor enter at mutually opposed locations, which current conductors are connected to an electric element in the lamp vessel and are fastened to the first and the second pole wire, respectively, outside the lamp vessel, the second pole wire having a longitudinal portion which extends along the lamp vessel to the second end portion of the envelope and into which a Z-shaped first support portion merges at a first bend location, which first support portion has a first support location adjacent the longitudinal portion and a second support location, and a central portion between said support locations, which first support portion is connected to a transverse portion which runs transversely to the axis through the envelope, to which said transverse portion the second current conductor is fastened, and by means of which a second support portion extending along the lamp vessel opposite the first support portion is connected to a third support location, and said second pole wire bearing on the second end portion of the envelope only at said first, second and third support locations.

8. An electric lamp as claimed in claim 7, wherein the longitudinal portion has a second bend location where the second pole wire is bent towards the axis.

9. An electric lamp as claimed in claim 7, wherein the first bend bends the second pole wire toward the axis.

10. An electric lamp as claimed in claim 7, wherein the third support location lies substantially in a plane through the axis and through a point centrally located between the first and second support locations.

11. An electric lamp as claimed in claim 10, wherein the transverse portion has a straight fastening portion to which the second current conductor is fastened and a bent portion which retains the second support portion substantially in a plane through the axis and through the point centrally located between the first and second support locations.

12. An electric lamp as claimed in claim 7, wherein the transverse portion has a fastening portion to which the second current conductor is fastened and said fastening portion is enveloped in nickel.

* * * * *